United States Patent [19]

Misson et al.

[11] 3,941,953

[45] Mar. 2, 1976

[54] KEYBOARD HAVING SWITCHES WITH TACTILE FEEDBACK

[75] Inventors: William W. Misson, Santa Rosa; Clarence K. Studley; William J. West, both of Los Altos; Edward T. Liljenwall, Sunnyvale, all of Calif.

[73] Assignee: Hewlett-Packard Company, Palo Alto, Calif.

[22] Filed: Aug. 23, 1971

[21] Appl. No.: 173,754

[52] U.S. Cl. ..... 200/5 R; 200/5 A; 200/67 DB; 200/159 B; 200/275; 200/302; 200/335; 200/340

[51] Int. Cl.[2] ..... H01H 13/26; H01H 1/06

[58] Field of Search ..... 200/1 R, 1 A, 5 R, 5 A, 200/6 R, 159, 159 B, 16 A, 11 TW, 67 D, 67 DA, 67 DB, 159 R, 159 A, 243, 275, 329–340, 85 A, 86 R, 16 D, 302

[56] References Cited

UNITED STATES PATENTS

| | | | |
|---|---|---|---|
| 2,808,476 | 10/1957 | Elliott | 200/243 X |
| 2,930,859 | 3/1960 | Nolden et al. | 200/16 A |
| 3,051,803 | 8/1962 | Brown | 200/243 X |
| 3,089,923 | 5/1963 | Wright | 200/5 A |
| 3,240,885 | 3/1966 | Grunfelder et al. | 200/5 A |
| 3,290,439 | 12/1966 | Willcox et al. | 200/5 A X |
| 3,600,528 | 8/1971 | Leposavic | 200/5 A |
| 3,627,935 | 12/1971 | Spievak | 200/5 A X |
| 3,666,899 | 5/1972 | Kerr | 200/16 D X |
| 3,673,357 | 6/1972 | Molchan | 200/5 A |

*Primary Examiner*—James R. Scott
*Attorney, Agent, or Firm*—Patrick J. Barrett

[57] ABSTRACT

An array of curved metal strips is supported over an array of conductors, and a key is supported over each intersection of a metal strip and a conductor. When a user depresses a key, a metal strip is pressed against a conductor to make an electrical connection. As the metal strip is deflected by the key, it snaps or buckles, providing tactile feedback to the user.

13 Claims, 14 Drawing Figures

INVENTORS
WILLIAM W. MISSON
CLARENCE K. STUDLEY
WILLIAM J. WEST
EDWARD T. LILJENWALL

INVENTORS
WILLIAM W. MISSON
CLARENCE K. STUDLEY
WILLIAM J. WEST
EDWARD T. LILJENWALL

INVENTORS
WILLIAM W. MISSON
CLARENCE K. STUDLEY
WILLIAM J. WEST
EDWARD T. LILJENWALL

INVENTORS
WILLIAM W. MISSON
CLARENCE K. STUDLEY
WILLIAM J. WEST
EDWARD T. LILJENWALL

INVENTORS
WILLIAM W. MISSON
CLARENCE K. STUDLEY
WILLIAM J. WEST
EDWARD T. LILJENWALL

KEYBOARD HAVING SWITCHES WITH TACTILE FEEDBACK

BACKGROUND OF THE INVENTION

Prior art keyboards may be divided into two categories: those which provide tactile feedback and those which do not. The switching mechanisms in prior art keyboards providing tactile feedback are relatively bulky and often mechanically complex. Some of that complexity is due to the use of separate mechanisms for the tactile feedback function and for the switching function. Many of the keyboards not providing tactile feedback are relatively compact, but suffer the disadvantage that the user is never sure if he has depressed a key sufficiently to close the switch. Some of these non-feedback type keyboards comprise two arrays of conductors separated by a small air space. When the user depresses a key, one of the conductors, an elastic member, is pressed against another conductor to make an electrical connection. Examples of both of these types of keyboards are shown in an article entitled "Keyswitches and Keyboards", EEE Magazine, pp. 64–73, November 1970.

SUMMARY OF THE INVENTION

The present invention comprises a keyboard in which the same physical elements perform the switching function and the tactile feedback function. An array of conductors is supported on a substrate such as a printed circuit board, and an array of metallic strips is supported over the array of conductors, with an air space between the two arrays. Each metal strip is curved about an axis lying in the plane of the substrate and a key is supported above each intersection of the arrays of conductors and metal strips. When a user depresses a key, it deflects a corresponding portion of a metal strip toward one of the array of conductors to make a switch closure. As the metal strip is deflected, it abruptly snaps or buckles, as the curvature is changed to give tactile feedback to the user. The snapping action results in a decrease in the resilience of the metal strip, which insures that the strip will be pressed against the corresponding one of the array of conductors. Thus, the tactile feedback assures the user that the key has been depressed sufficiently to close the switch.

DESCRIPTION OF THE PREFERRED EMBODIMENTS

Figure 1:
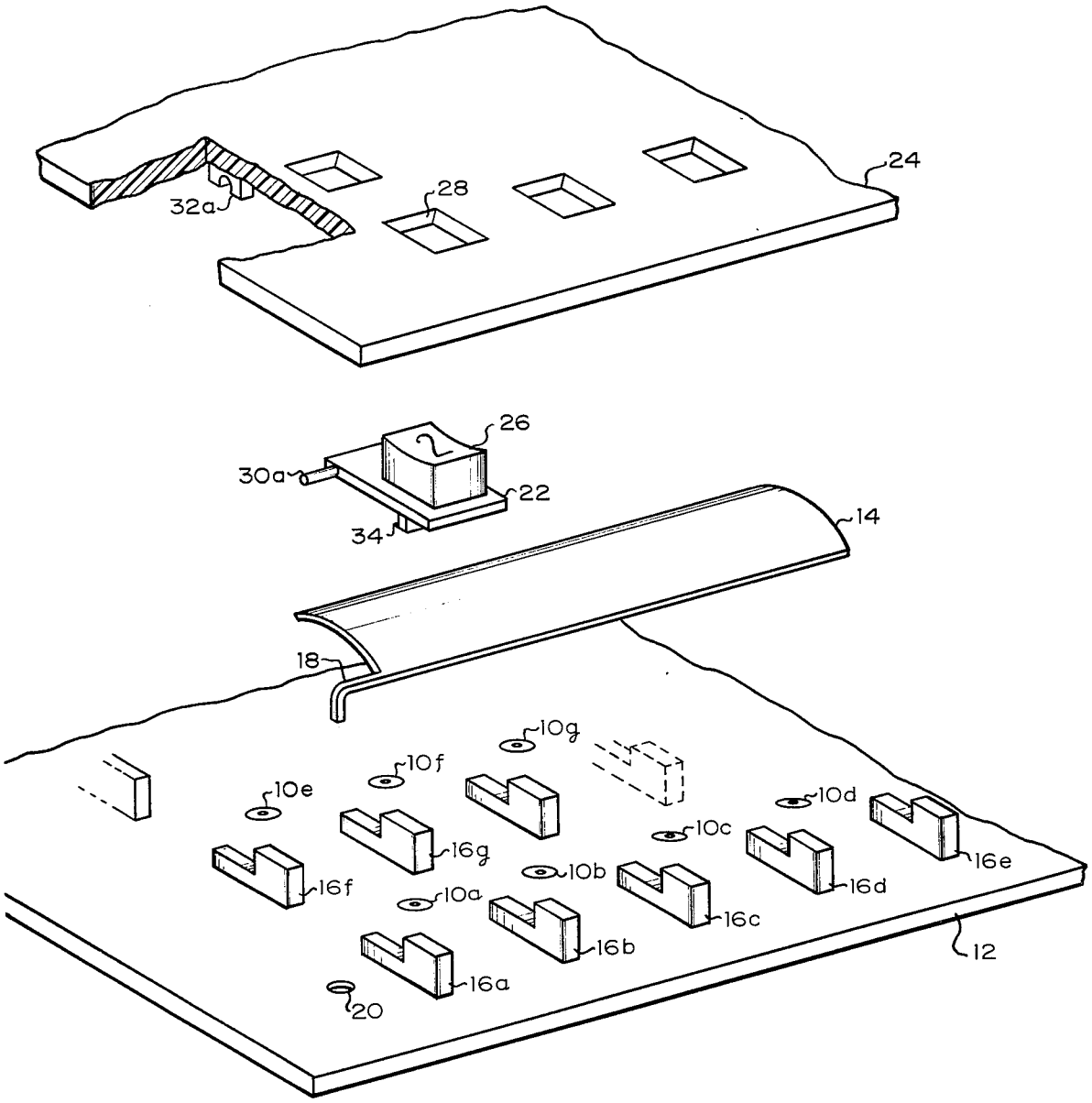
FIG. 1 shows an exploded perspective view of one preferred embodiment of the present invention.
Figure 2A:
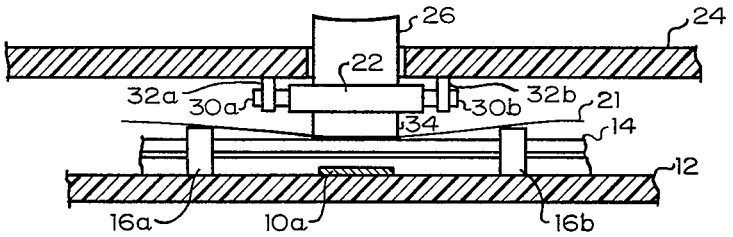
FIGS. 2 *a–c* show cutaway side views of the device of FIG. 1.
Figure 2B:
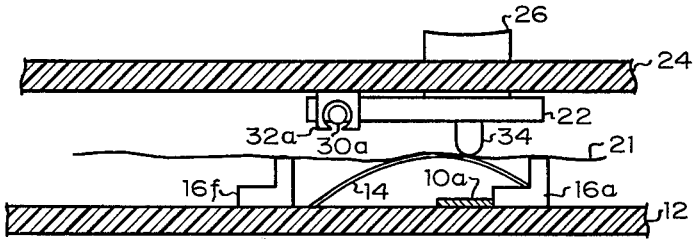

One of the preferred embodiments of the present invention is shown in FIGS. 1 and 2 *a–c*. An array of conductors 10 is supported on a rigid substrate 12, which may comprise an etched printed circuit board, for example. Each conductor 10 forms one contact of a switch. Wires or printed circuit conductors may attach to each conductor 10 from the underside of substrate 12. A curved conductive strip 14, made of beryllium-copper, for example, is supported above each row of conductors (e.g. conductors 10*a*–10*d*) by a series of insulating supports 16. Each conductor has an insulating support on either side of it, as, for example, conducotr 10*a* has insulating supports 16*a* and 16*b* beside it. A tab 18 on strip 14 fits into a hole 20 in substrate 12 to retain strip 14 and also to provide an electrical connection with it. Alternate means can also be used to retain and make contact to strip 14, such as insulative blocks fastened to substrate 12 at each end of strip 14 and a conductor on substrate 12 under one edge of strip 14. As can be seen from FIG. 2*b*, insulating supports 16 also act as retainers for strip 14. Also illustrated in FIGS. 2*a* and 2*b* is a thin plastic membrane 21 which protects the conductors from contamination such as dust. Membrane 21 is omitted from subsequent figures for the sake of clarity.

A key 22 is supported over each conductor 10 by a support member 24, and a button portion 26 of key 22 projects through a hole 28 in the support member. Shafts 30*a* and 30*b* on key 22 are rotatably mounted in journals 32*a* and 32*b* to constrain the key to move in an approximately up and down fashion. A protrusion 34 on key 22 rests on strip 14, and thus the strip holds the key in its up position. This description of key 22 is offered as just an example since other key embodiments are possible.

Figure 2C:
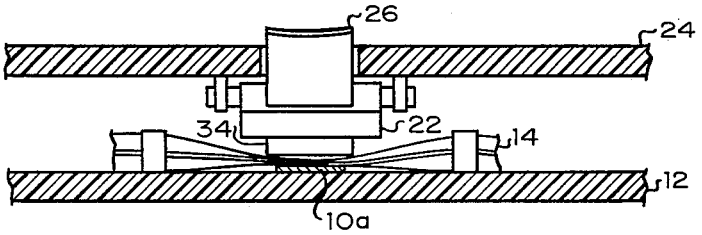

When a user depresses key 22, protrusion 34 deflects strip 14 toward conductor 10*a* as illustrated in FIG. 2*c*. Strip 14 acts as a spring and thus offers increasing resistance as the key is depressed. However, after the strip has been deflected part way toward conductor 10*a*, the curvature of the strip will flatten out and the resilience of the strip will decrease abruptly. The user will feel the strip snap and the decrease in resilience will insure that the key is depressed completely to make electrical contact between strip 14 and conductor 10*a*, as shown in FIG. 2*c*. This action is illustrated in the force-deflection curve of FIG. 3. At inflection point 50 the resilience of the strip abruptly changes and it then decreases with further deflection until inflection point 52 is reached. At this second inflection point the resilience of the strip again changes. It is desirable that strip 14 make electrical contact with conductor 10*a* at some point on the force-deflection curve between points 50 and 52. When the user releases key 22, strip 14 will snap back to its curved configuration and will return the key to its up position. It is desirable that the electrical contact also break between points 50 and 52 on the force-deflection curve. Such a relationship between the strip resilience and the making and breaking of electrical contact insures that the user will receive the tactile feedback at the appropriate time.

The amount of tactile feedback to the user depends on the abruptness in the change in resilience of strip 14. That abruptness is determined, inter alia, by the length and shape of protrusion 34, the spacing between insulating supports 16, the width and curvature of strip 14, and the amount of restraint on the ends of strip 14, such as at tab 18. If the change in resilience is very abrupt, the user will hear it as an audible click as well as feel it. The abruptness may be increased, for example, by making protrusion 34 shorter and more pointed, or by decreasing the space between insulating supports 16. However, it is believed that the life of strip 14 is reduced by increasing the abruptness of the change in resilience. Therefore, the amount of tactile feedback provided by a key must be traded off against such considerations as life of the switching element.

Figure 3:
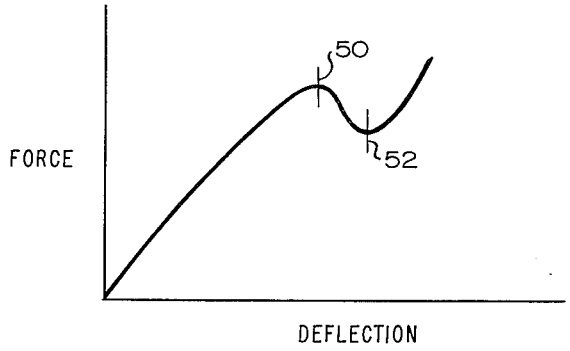
FIG. 3 shows a force-deflection curve for a key switch having tactile feedback.
Figure 4:
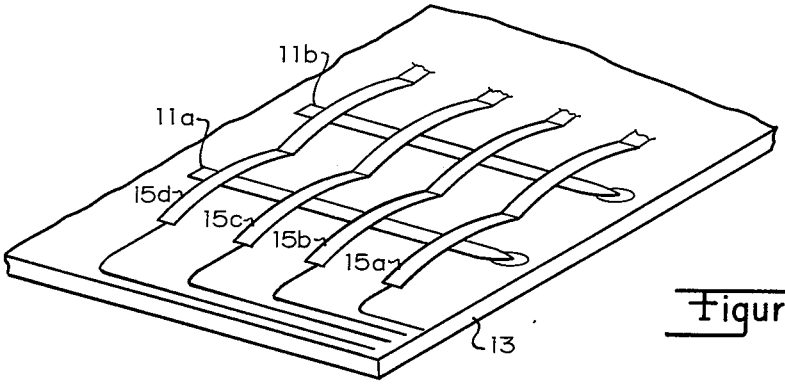
FIG. 4 shows a perspective view of a portion of another preferred embodiment.
Figure 5A:
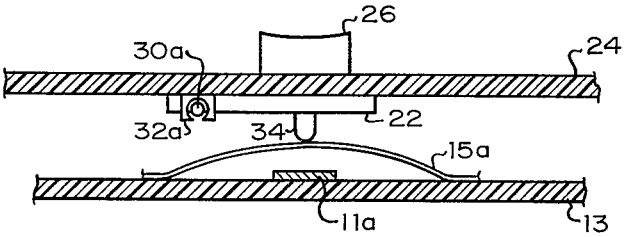
FIGS. 5 *a–b* show cutaway side views of the device of FIG. 4.
Figure 5B:
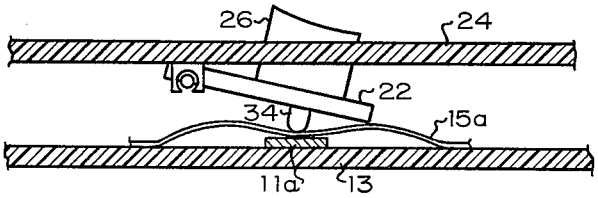

A second preferred embodiment is shown in FIGS. 4 and 5 *a–b*. Conductors 11 are supported on a substrate 13 and curved strips 15 arch over conductors 11. Strips 15 are fastened to substrate 13 on either side of each conductor 11 by soldering, for example. As illustrated in FIG. 5*a*, key 22 is held in the up position by a strip 15*a*. When key 22 is depressed, strip 15*a* is deflected toward conductor 11*a*. The strip offers increasing resistance to the key as the key is depressed until the strip snaps or buckles with a change in curvature. At that point, the resilience of the strip abruptly decreases insuring that the user will completely depress the key to make an electrical contact between metal strip 15*a* and conductor 11*a* as shown in FIG. 5*b*. This action is illustrated in FIG. 3, as discussed above. When the user releases the key, the strip will snap back to its arched configuration and will return the key to its up position.

Figure 6:
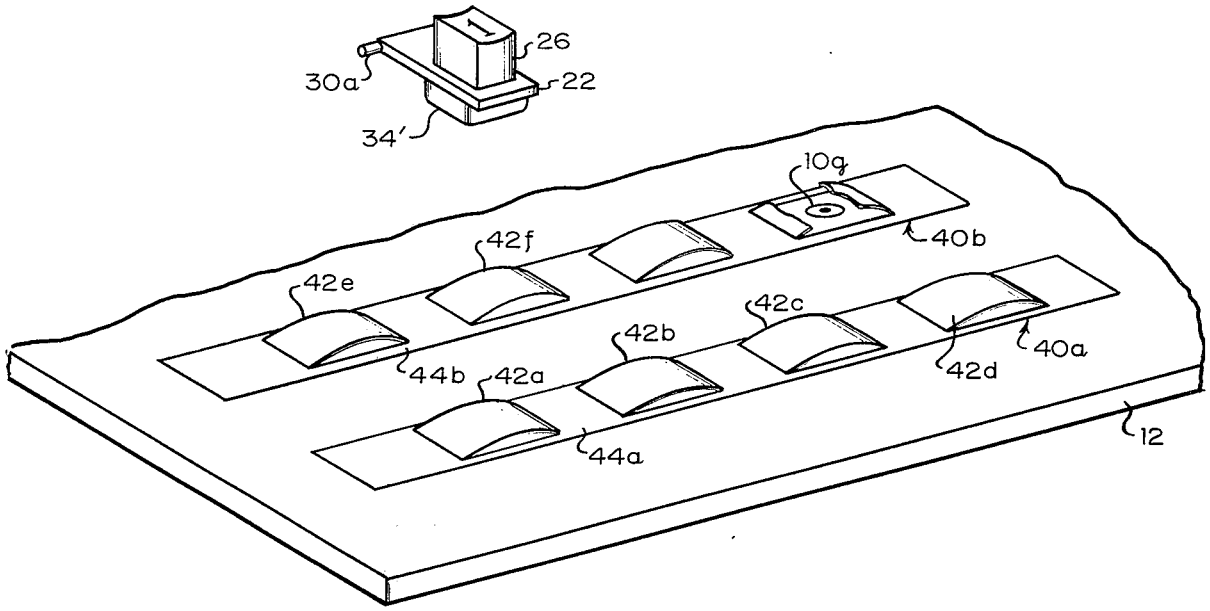
FIG. 6 shows an exploded perspective view of an alternative embodiment of the device of FIG. 4.
Figure 7A:
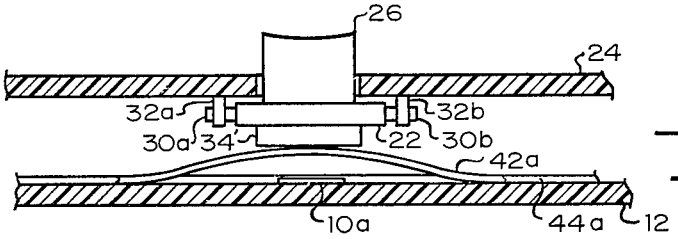
FIGS. 7 *a–c* show cutaway side views of the device of FIG. 6.
Figure 7B:
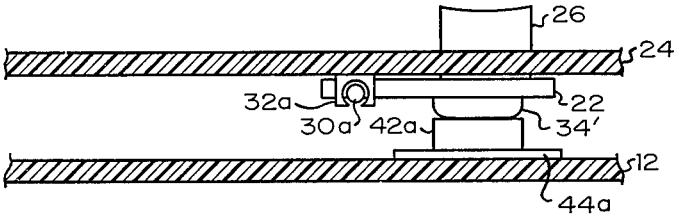
Figure 7C:
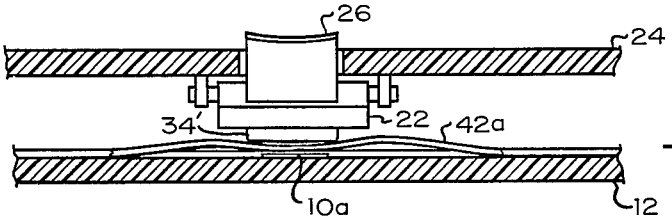

A third preferred embodiment is shown in FIGS. 6 and 7 *a–c*. As in the first embodiment, the substrate 12 supports a plurality of contacts 10. Strip assemblies 40 fastened to the substrate, comprise curved strips 42 and mounting portions 44. Strips 42 are similar to strips 15 except that they are integral with mounting portions 44. Strip assemblies 40 may be formed from a single piece of material by a process such as stamping. Mounting portions 44 are fastened to substrate 12, by soldering to printed circuit pads, for example. This method of fastening strips 42 to substrate 12 is more easily repeatable under production conditions than the method shown in FIG. 4. The operation of the switching element, illustrated in FIGS. 7 *a–c*, is essentially the same as described for the second embodiment. Depression of key 22 deflects strip 42*a* toward conductor 10*a*. As the strip flattens out it changes resilience, providing tactile feedback and making contact with the conductor.

Figure 8:
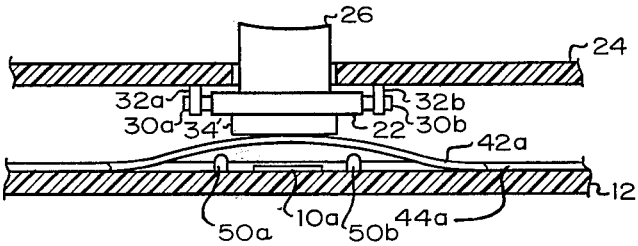
FIG. 8 shows a cutaway side view of an alternative embodiment of the device of FIG. 6.
Figure 9:
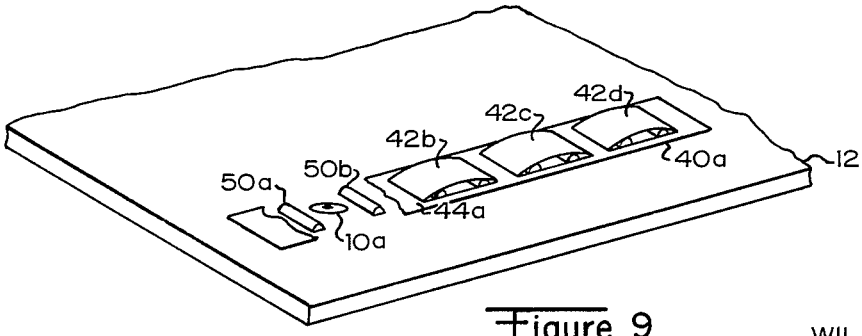
FIG. 9 shows a perspective view of a portion of FIG. 8.

FIGS. 8 and 9 illustrate a slight modification of the embodiment discussed above in connection with FIGS. 6 and 7. Protrusions 50*a* and 50*b* are attached to substrate 12 on either side of conductor 10*a*. When key 22 deflects strip 42*a* toward conductor 10*a*, protrusions 50*a* and 50*b* help insure that the strip will buckle in the middle and not off to one side. If protrusions 50*a* and 50*b* are omitted and the key is not centered over the curvature of the strip, the strip may buckle asymmetrically when deflected and fail to make contact with conductor 10*a*. In addition, protrusions 50*a* and 50*b* help insure repeatability and uniformity of the tactile feedback. Strips 42 may also be flattened slightly at the mid-portion of their curvature to help them buckle symmetrically when deflected.

An additional trade off in the selection of the configuration of key 22 is the relation of the shape of protrusion 34 to the repeatability of the tactile feedback. In FIG. 7 protrusion 34' is illustrated as much larger than protrusion 34 of previous figures. The broad flat surface of protrusion 34' insures a more symmetrical and repeatable buckling of strip 42*a*.

The embodiments herein described can also be used to actuate non-contacting type keyboards such as the one described in copending patent application Ser. No. 74,949 now U.S. Pat. No. 3,668,697 entitled Non-Contacting Keyboard by David S. Cochran and Glenn E. McGhee, assigned to the assignor of the present invention. Additionally, the strips 14, 15 or 42 can be used to connect pairs of contacts on the substrates.

What is claimed is:

1. A switching apparatus comprising:

a rigid substrate;

first conductive means comprising at least one conductor supported on the substrate;

second conductive means comprising at least one conductive strip having at least a portion thereof arched about an axis substantially parallel to the surface of the substrate and supported over the first conductive means to form one or more intersections of the arched portion of the second conductive means and the first conductive means; and actuator means supported over the second conductive means comprising an actuator for each intersection of the first and second conductive means for deflecting the arched portion of the second conductive means into contact with the first conductive means and for causing the resilience of the arched portion of the second conductive means to change abruptly in response to deflection by an actuator, whereby tactile feedback is provided to a user actuating an actuator.

2. A switching apparatus as in claim 1 including support means attached to the substrate for supporting a conductive strip of the second conductive means at spaced intervals along the length of the conductive strip and a support member for supporting the actuators of the actuator means, wherein:

the conductive strip is arched about an axis along the longest dimension of the conductive strip; and the first conductive means includes a plurality of conductors at spaced intervals on the substrate substantially between the support means.

3. A switching apparatus as in claim 2 wherein:

the actuators are one-piece keys rotatably mounted in bearings attached to the support member; and actuation of an actuator comprises depression of one of the keys by the user to deflect the conductive strip toward and into contact with one of the plurality of first conductors, the curvature of the conductive strip changing during deflection to effect said abrupt change in resilience.

4. A switching apparatus as in claim 3 wherein the support means comprises a plurality of stepped protrusions from the substrate located between the intersections of the conductive strip and each of the plurality of conductors, the stepped protrusions supporting one edge of the conductive strip above the substrate.

5. A switching apparatus as in claim 1 including a support member for supporting the actuators of the actuator means wherein:

the second conductive means comprises a plurality of conductive strips each arched about an axis substantially perpendicular to the longest dimension of each conductive strip and substantially parallel to the surface of the substrate, each end of each conductive strip being fastened to the substrate; and the first conductive means comprises an elongated conductor situated under the arched portions of a plurality of conductive strips.

6. A switching apparatus as in claim 5 wherein:

the actuators are one-piece keys rotatably mounted in bearings attached to the support member; and actuation of an actuator comprises depression of one of the keys by the user to deflect a corresponding conductive strip toward and into contact with the elongated conductor, the curvature of the conductive strip changing during deflection to effect said abrupt change in resilience.

7. A switching apparatus as in claim 1 including a support member for supporting the actuators of the actuator means wherein:

the first conductive means comprises a plurality of conductors situated at spaced intervals on the substrate;

the second conductive means comprises a conductive strip having a plurality of arched portions, each arched portion being arched over one of the plurality of conductors, and the conductive strip being attached to the substrate between the arched portions.

8. A switching apparatus as in claim 7 wherein:

the actuators are one-piece keys rotatably mounted in bearings attached to the support member; and depression of one of the keys by the user deflects a corresponding one of the arched portions of the conductive strip toward and into contact with one of the plurality of conductors, the curvature of the arched portion of the conductive strip changing during deflection to effect said abrupt change in resilience.

9. A switching apparatus as in claim 8 including a plurality of protrusions on the substrate higher than the plurality of conductors and situated on opposite sides of each of the plurality of conductors along an axis perpendicular to the axis of curvature of the arched portions for coacting with an arched portion when deflected to insure contact with a corresponding one of the plurality of conductors.

10. A switching apparatus as in claim 8 including a flexible, insulative member disposed between the first and second conductive means and the actuators to protect the first and second conductive means from contamination.

11. A switching apparatus as in claim 1 wherein the second conductive means comprises a conductive strip having a portion arched about the longitudinal axis of the conductive strip, each end of the strip being fastened to the substrate.

12. A switching apparatus as in claim 1 wherein the second conductive means comprises a conductive strip having a portion arched about a transverse axis of the conductive strip substantially parallel to the surface of the substrate with each end of the strip fastened to the substrate.

13. A push button switching apparatus comprising:

a base;

a plurality of bearings attached by means to the base;

a plurality of electrical contacts mounted on the base;

a bridging electrical conductor supported by the base over selected ones of the electrical contacts and movable into and out of contact with the selected ones of the electrical contacts; and a plurality of key bodies, each having a button portion, a protrusion on the button portion for engaging the bridging electrical conductor, a lateral tab portion extending from the button portion and a shaft portion attached to the lateral tab portion and rotatably mounted in one of the bearings, for deflecting the bridging electrical conductor into contact with a corresponding electrical contact in response to a user pushing the button portion.

* * * * *